US005785221A

United States Patent [19]

Bishop

[11] Patent Number: 5,785,221

[45] Date of Patent: Jul. 28, 1998

[54] SLOT POCKET

[76] Inventor: Patricia M. Bishop, 132 Old Broadway Ave., Sayville, N.Y. 11782

[21] Appl. No.: 861,195

[22] Filed: May 21, 1997

[51] Int. Cl.[6] ..... A45F 5/00

[52] U.S. Cl. ..... 224/269; 224/254; 224/255; 224/191; 24/3.13; 206/38

[58] Field of Search ..... 224/180, 191, 224/194, 197, 199, 219, 220, 676–679, 242, 255, 254, 256, 269, 272, 182; 24/3.1, 3.13, 3.7, 3.11; 206/37, 38, 39, 449, 555; 283/904; 150/147–149; 220/326

[56] References Cited

U.S. PATENT DOCUMENTS

| | | | |
|---|---|---|---|
| 1,252,268 | 1/1918 | Jennings | 224/182 |
| 1,513,383 | 10/1924 | Fleischer | 24/3.13 |
| 1,575,524 | 3/1926 | Benjamin et al. | 220/326 |
| 1,618,088 | 2/1927 | Hinrichs | 224/182 |
| 4,518,080 | 5/1985 | Ohlson | 206/39 |
| 5,027,477 | 7/1991 | Seron | 24/3.13 |
| 5,226,252 | 7/1993 | Haluska | 40/634 |
| 5,274,937 | 1/1994 | Birnbaum | 40/600 |
| 5,358,114 | 10/1994 | Neugebauer | 206/449 |
| 5,388,739 | 2/1995 | Gargan . | |
| 5,421,498 | 6/1995 | Menoni | 224/220 |
| 5,524,749 | 6/1996 | Thompson et al. | 206/38 |
| 5,592,767 | 1/1997 | Treske | 24/3.11 |

*Primary Examiner*—Allan N. Shoap
*Assistant Examiner*—Gregory M. Vidovich
*Attorney, Agent, or Firm*—Patent & Trademark Services; Thomas Zack; Joseph H. McGlynn

[57] ABSTRACT

An apparatus configured for mounting a casino issued slot club member card. The apparatus includes a card mount backing surface having side and bottom card lip retaining elements and an attached stretchable elongated coil member having a swivel mounted normally closed openable end piece. By opening this end piece, a slot card can be mounted to the piece through a preexisting hole in the card. The card mount has an upper back safety pin with a swivel connection used to attach the mount to a user's clothing.

3 Claims, 1 Drawing Sheet

SLOT POCKET

BACKGROUND OF THE INVENTION

Games involving chance have become very popular in this country. In particular, slot machines having insertable cards which record the play activity of slot club members have been widely known. Unfortunately, some players, after inserting such a card into a machine and finished their play, forget to remove the card and as a consequence suffer its loss.

The present invention acts to remind the player that his or her card is inserted into the slot machine by providing for a player mount mounted to the player by a swivel attachment which in turn is attached to an extended coiled flexible extension. At this extension's other end is another swivel attachment mounted to an openable snap swivel. A preformed hole in the slot card receives the snap swivel to permit the card's attachment to the player. When a player forgets and leaves the slot card in a machine, their tensioned attached coiled extension will gently remind them of this thereby insuring its removal.

DESCRIPTION OF THE PRIOR ART

Article mounts having openable end members are known. For example, in U.S. Pat. No. 5,226,252 to Haluska a photo frame key chain is disclosed which has a photo holding cubic connected to a key chain with a releasable catch key ring. The patent (U.S. Pat. No. 5,274,937) to Birnbaum describes a magnet holder capable of coupling to a metallic surface having a pocket for storing materials.

Some card holders, such as U.S. Pat. No. 5,358,114 to Neugebauer, have a card holding pocket with a transparent cover that slides into a lip on the holder's base. And in U.S. Pat. No. 5,388,739 to Gargan a thin transparent plastic pocketed envelope with a loop neck band is used to hold a commuter ticket. The present invention differs from this prior art and the known art by providing for a card mount attachable to a person's clothing and a flexible coiled extension attached to the mount. At the extension's other end is a swivel mounted snap swivel for the removed card as more further set forth in this specification.

SUMMARY OF THE INVENTION

This invention relates to an assembly having a card mount attachable to a person's clothing with an extending flexible coil extension. At the extension's other end is a swivel mounted snap swivel attachable to the card through a preformed hole.

It is the primary object of the present invention to provide an improved assembly to mount a card having a flexible extension attached to the card.

Another object is to provide for a card mount assembly which is designed to remind a player that the card has been inserted into a machine.

These and other objects and advantages of the present invention will become apparent to readers from a consideration of the ensuing description and the accompanying drawings.

DESCRIPTION OF THE PREFERRED EMBODIMENT

Figure 1:
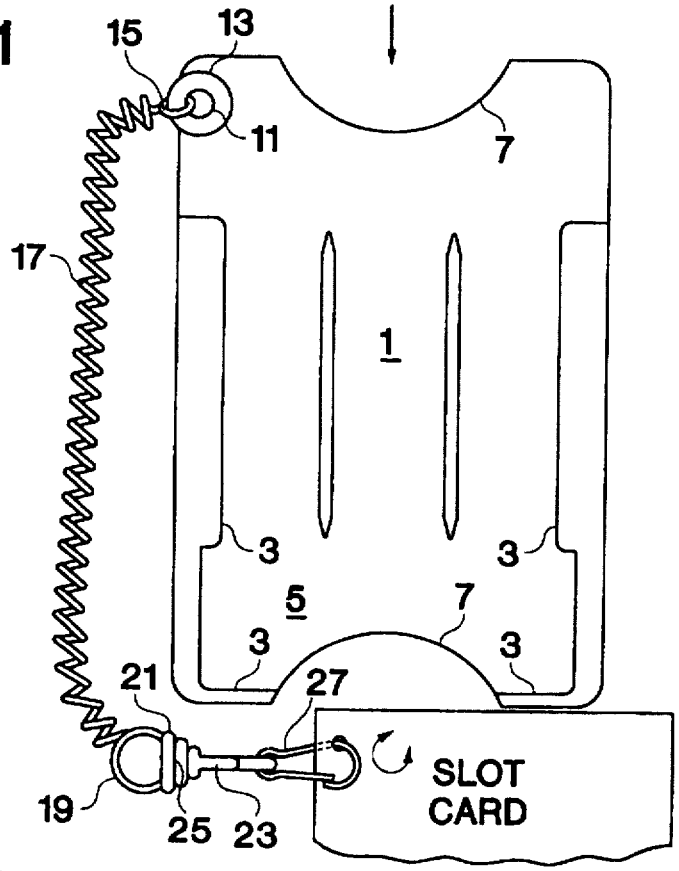
FIG. 1 is a front view of the invention's preferred embodiment.

FIG. 1 is a front view of the invention's preferred embodiment. The card mount backing 1 is made of a molded rigid plastic material which is rectangular and generally flat in shape. Located along its two opposite sides and lower edge are guide rails or lips 3 which extend slightly upward from the mount's flat surface 5 to form a retaining pocket for an inserted card. An appropriately sized and shaped slot card is inserted from above in the direction of the arrow to rest between the backing surface 1 and the three lip extending edges 3. Also, shown on the mount 1 are optional semi-circular top and bottom mount cut outs 7. If desired the cut outs 7 may be omitted from the mount. Located at the top left side of the mount 1 is a round through hole 11 with an encircling grommet 13. Extending through hole 11 is a ring 15 used to hold the upper end of a flexible coiled elongated stretchable member 17 to the mount 1 by an intervening crimp connection. Alternately, member 17 could be riveted directly to the mount at its top.

The unstretched and non-tensioned coiled member 17 is about 8 inches long which is over twice the typical length (about 3.5 inches) of mount 1. When pulled and tensioned, this flexible member 17 can stretch to a length of over five feet. Thus, the material making up member 17 is a coil spring-like material which can extend to a length several times its unstretched length when subject to a tensioning force and then return to substantially the original unstretched length when the tensioning force is removed.

Located at the member's 17 other end is a ferrule/eye piece 19 crimped over the coil's end. This ring eye piece 19 engages another ring 21 which forms part of the end swivel snap member 23. A side slit 25 in member 23 indicates where member 23 swivels or rotates about its center longitudinal axis as depicted by the arrows. The looped end of member 23 can be opened by depressing its normally closed spring biased leg portion 27 to permit the attachment of appropriate objects to the loop. For example, the preformed hole in a slot card (the top part of which is illustrated) may be slid into the looped end of member 23 when loop leg portion 27 is depressed. When leg portion 27 is released, the loop is biased to a closed position again to hold the slot card therein.

Figure 2:
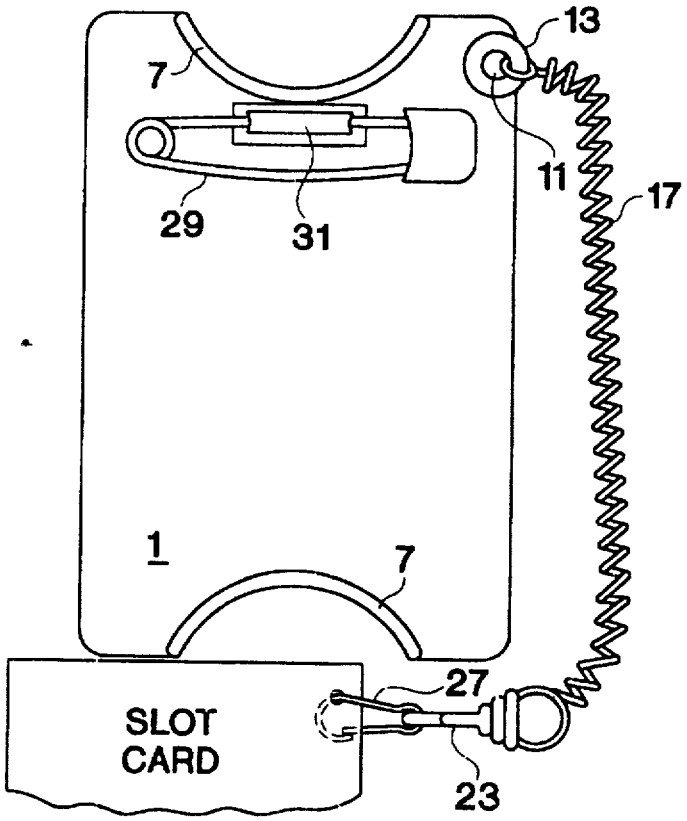
FIG. 2 is a back view of the FIG. 1 embodiment.

FIG. 2 is a back view of the FIG. 1 mount embodiment. In this view the swivel top mounted safety pin 29 used to attach the mount 1 to a user's clothing, like their shirt or blouse pocket, is visible. By making the mount connection 31 between the pin 29 and back of the mount 1 a swivel connection, when the mount is attached to a person, the mount connection provides a greater degree of freedom of movement by that person. The other shown features and elements of FIG. 2 have been previously described in the description of FIG. 1, and no further description is believed necessary.

Clearly, variations can be made to the disclosed preferred embodiment. The card retaining lips 3 can extend almost completely up the mount's two opposite sides and along its bottom edge or only partially as long as the lips have sufficient bearing surface to retain the insert card. The coil flexible member 17 can be made of any type of flexible string material, such as a bungee type of cord, that can easily stretch, when subject to tension, and then return to its original position when non-tensioned. In addition, materials other than plastic may be used to construct the card mount and its flexible member 17.

In use, a player would take the inserted card from the card mount 1 by pulling it upward by its card edges. After the card is inserted into a game playing machine (not shown) and the playing completed, the card can be remounted into its retaining mount 1 for safe keeping. Should the player forget to remove the inserted card from its game playing machine, the attached member 17 will stretch gently to remind the player of this fact when attempting to leave the machine. The upper swivel mount connection 31 to the mount and swivel snap member 23 permit great unhindered movement and flexibility between the player and the game machine as playing takes place.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. Card mount apparatus comprising:

a card mount having side and bottom card retaining elements for retaining a slot card inserted therein, said card retaining elements respectively extend upwardly from the sides and bottom of the card mount to form a retaining lip thereon;

means for attaching said card mount to the clothing of a user including a safety pin mounted to the back of the card mount by a pivotal connection;

a flexible elongated member attached to said card mount and extending therefrom, said member terminating in an end remoted from the mount; and a swivel mounted normally closed openable end piece mounted to the terminating end of the elongated flexible member, said end piece being adapted when opened to hold the card inserted in said card mount.

2. The apparatus as claimed in claim 1, wherein said flexible elongated member attached to said card mount includes a coil spring material, wherein said flexible member has an original unstretched length which can extend to a length several times the original unstretched length when subject to a tensioning force and then substantially return to the original unstretched length when the tensioning force is removed.

3. The apparatus as claimed in claim 2, wherein said swivel mounted openable end piece is mounted to the terminating end of the elongated flexible member by an eye ferrule connection.

* * * * *